US006986166B2

(12) United States Patent
Cho

(10) Patent No.: US 6,986,166 B2
(45) Date of Patent: Jan. 17, 2006

(54) CAP

(75) Inventor: Byoung-Woo Cho, Yongin (KR)

(73) Assignee: Yupoong, Inc., Seoul (KR)

( * ) Notice: Subject to any disclaimer, the term of this patent is extended or adjusted under 35 U.S.C. 154(b) by 93 days.

(21) Appl. No.: 10/470,058

(22) PCT Filed: Mar. 28, 2002

(86) PCT No.: PCT/KR02/00548

§ 371 (c)(1),
(2), (4) Date: Jul. 24, 2003

(87) PCT Pub. No.: WO03/070037

PCT Pub. Date: Aug. 28, 2003

(65) Prior Publication Data

US 2004/0049829 A1 Mar. 18, 2004

(30) Foreign Application Priority Data

Feb. 19, 2002 (KR) ..... 2002-8824

(51) Int. Cl.
*A41D 19/00* (2006.01)

(52) U.S. Cl. ..... 2/195.5

(58) Field of Classification Search ..... 2/10, 2/12, 195.1; 40/329; 428/63
See application file for complete search history.

(56) References Cited

U.S. PATENT DOCUMENTS

| | | | | |
|---|---|---|---|---|
| 5,159,720 | A * | 11/1992 | Scott, Jr. | 2/171 |
| 5,410,761 | A * | 5/1995 | Connelly et al. | 2/195.1 |
| 5,588,156 | A * | 12/1996 | Panton, Jr. | 2/243.1 |
| 5,701,607 | A * | 12/1997 | Kaiser | 2/209.13 |
| 5,903,923 | A | 5/1999 | Morse | |
| 6,021,525 | A | 2/2000 | Mertins | |
| 6,035,446 | A | 3/2000 | Johnson | |
| 6,449,773 | B1 * | 9/2002 | Shwartz et al. | 2/195.1 |
| 6,766,538 | B2 * | 7/2004 | Park | 2/175.4 |

FOREIGN PATENT DOCUMENTS

| | | |
|---|---|---|
| KR | 20-0188202 | 4/2000 |
| KR | 2000-0005865 | 4/2000 |
| WO | 03/070037 A1 | 8/2003 |

* cited by examiner

*Primary Examiner*—Katherine M. Moran
(74) *Attorney, Agent, or Firm*—Staas & Halsey LLP

(57) ABSTRACT

A cap includes a crown portion for disposing on a head, and a visor portion for shielding a face from sunlight, the visor portion being coupled to the crown portion. The visor portion is provided with a symbol portion formed as an engraved shape or a hole.

6 Claims, 3 Drawing Sheets

CAP

BACKGROUND OF THE INVENTION (a) Field of the Invention

The present invention relates to a cap and, more particularly, to a cap that is designed to improve esthetic appearance.

(b) Description of the Related Art

Generally, a cap has a crown portion and a visor portion coupled to the crown portion, for protecting and shading the face from sunlight. In recent years, it has been required that such a cap be made with an unusual design for persons of marked individuality and for the purpose of advertisement. To meet this requirement, the applicant has developed a cap that has an enhanced esthetic appearance for a person of marked individuality, while providing an advertisement effect.

SUMMARY OF THE INVENTION

Therefore, the present invention has been made in an effort to meet the above described need.

It is an objective of the present invention to provide a cap that can enhance the esthetic appearance for a person of marked individuality, while providing an advertisement effect.

To achieve the above objective, the present invention provides a cap comprising a crown portion for disposing on a head; and a visor portion for shielding a face from sunlight, the visor portion being coupled to the crown portion, wherein the visor portion is provided with a symbol portion formed as an engraved shape or a hole. The symbol portion provides various esthetic appearances because of a cloth that also covers the visor portion so that the symbol portion is viewed through the cloth.

Preferably, the cloth is selected from the group consisting of mesh cloth, transparent cloth, and semitransparent cloth. Further preferably, the cloth contains luminous material.

Preferably, the symbol portion is filled with colored or colorless material, and has the shape of a letter, mark, or character.

DETAILED DESCRIPTION OF THE PREFERRED EMBODIMENTS

The preferred embodiments of the present invention will be described in more detail in conjunction with the attached drawings.

Figure 1:
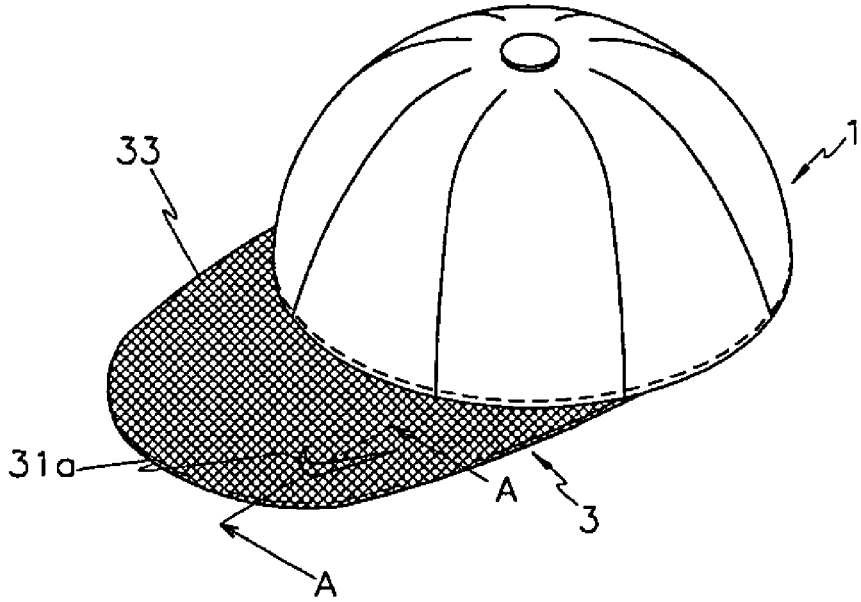
FIG. 1 is a perspective view of a cap according to a first embodiment of the present invention.

Referring to FIG. 1, a cap according to a first embodiment of the present invention has a crown portion 1 for mounting on a head, and a visor portion 3 connected to the crown portion 1. The visor portion 3 may be connected to the crown portion by needlework, and the crown portion 1 is designed to cover all of the head, as shown in FIG. 1. However, it may be designed in a band or rim shape surrounding only the circumference of the head.

Figure 2:
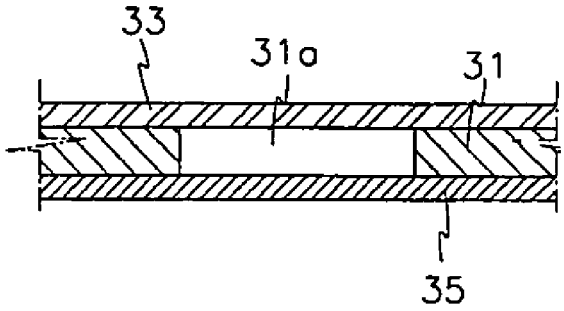
FIG. 2 is a sectional view taken along line A—A in FIG. 1.

The visor portion 3 is for blocking sunlight from the face. As shown in FIG. 2, the visor portion 3 has a shape-maintaining member 31, a top cloth 33 disposed on a top surface of the shape-maintaining member 31, and a bottom cloth 35 disposed on a bottom surface of the shape-maintaining member 31.

The shape-maintaining member 31 is preferably formed of synthetic resin or paperboard so as to maintain the predetermined shape of the visor portion 3. The shape-maintaining member 31 is provided with a symbol portion 31*a* for such things as characters, letters, and trademarks formed by engraving a portion thereof. That is, the symbol portion 31*a* is formed as an engraved groove or a hole by a laser cutting process.

Figure 3:
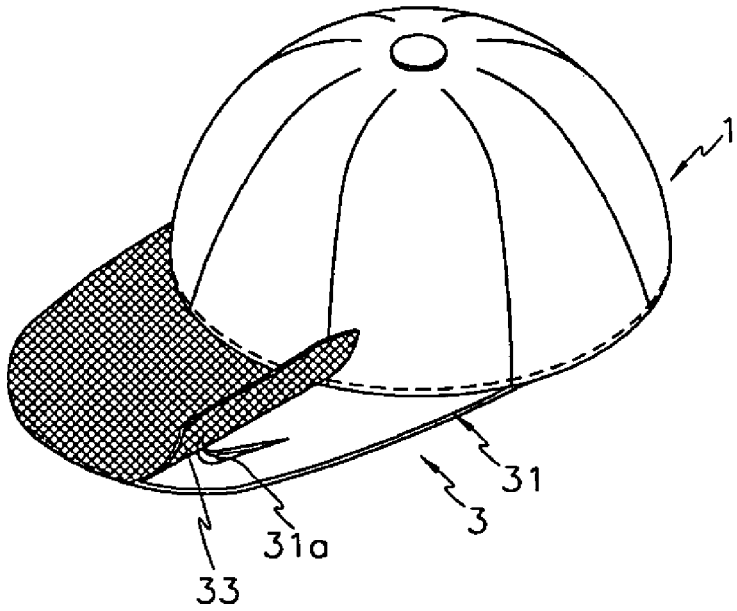
FIG. 3 is a partial sectional view of a major part of a cap according to a first embodiment of the present invention.

FIG. 3 shows a cap of the first embodiment, in which a portion of the top cloth is removed.

The top cloth 33 may be attached to the head-wearing portion 1, the shape-maintaining member 31, and the bottom cloth 35 by, for example, needlework or by adhesive, depending on the design or manufacturing process of the cap.

Particularly, it is preferable that the top cloth 33 is selected from the group consisting of mesh cloth, transparent cloth, and semitransparent cloth so that the symbol portion 31*a* can be exposed through the cloth. To improve the esthetic appearance, it is further preferable that the top cloth 33 is formed in a variety of colors so that the symbol portion 31*a* can be seen through the top cloth 33. In addition, the top cloth 33 may be formed of cloth containing luminous material so as to further enhance the esthetic aspect and to improve the safety of the user at night.

The bottom cloth 35 is fixable to the top cloth 33 by needlework. When the bottom cloth 35 is formed in a variety of colors, the symbol portion 31*a* can be represented in a variety of colors, making it possible to design a cap capable of providing various esthetic appearances. The bottom cloth 35 may be made of material identical to the top cloth 33, but the present invention is not limited to this embodiment. The bottom cloth 35 may also be formed of nontransparent cloth.

As described above, the shape-maintaining member 31 provided with the symbol portion 31*a* is coupled to the crown portion 1 by needlework of the top and bottom cloth 33 and 35. However, needlework is only one embodiment, not limiting the present invention. The visor portion may be coupled to the crown portion by a variety of methods. In addition, the crown portion may be designed in a band shape.

In the above-described cap, when light passes through the symbol portion 31*a*, the shape of the symbol portion 31*a* is represented so that it can be identified. The color of the shape represented by the symbol portion 31*a* can be varied according to the color of the top cloth 33 covering the symbol portion 31*a*, improving the esthetic appearance.

Figure 4:
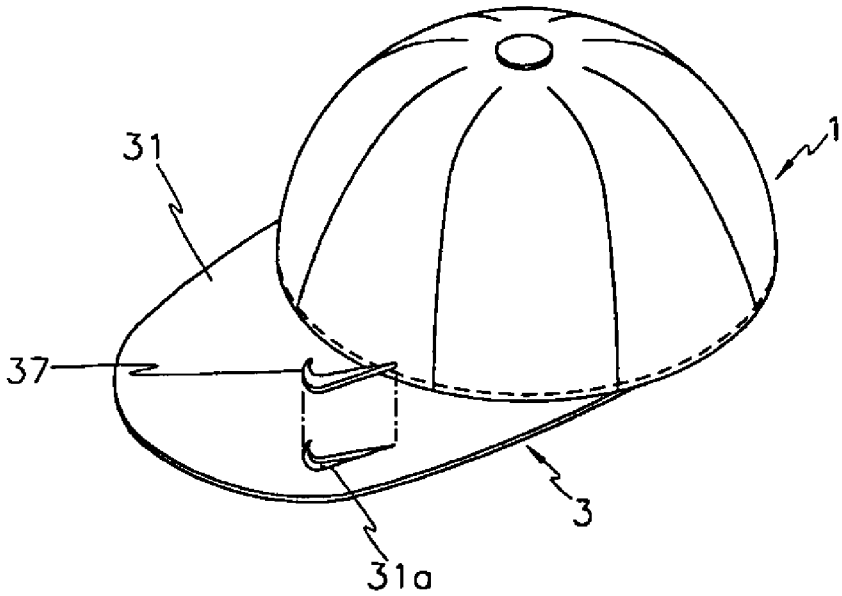
FIG. 4 is a view of a cap according to a second embodiment of the present invention.

Referring now to FIG. 4, a cap according to a second embodiment of the present invention will be described. As in the first embodiment, the visor portion 3 is provided with a symbol portion 31*a*. The symbol portion 31*a* of this embodiment is formed of material having a different color to that of the shape-maintaining member 31. A filler 37 having an identical shape to the symbol portion 31*a* may be filled in the symbol portion 31*a*. In this embodiment, the top and bottom cloth 33 and 35 described in the first embodiment may be omitted.

The cap of this second embodiment further improves the esthetic appearance when compared with that of the first embodiment.

Figure 5:
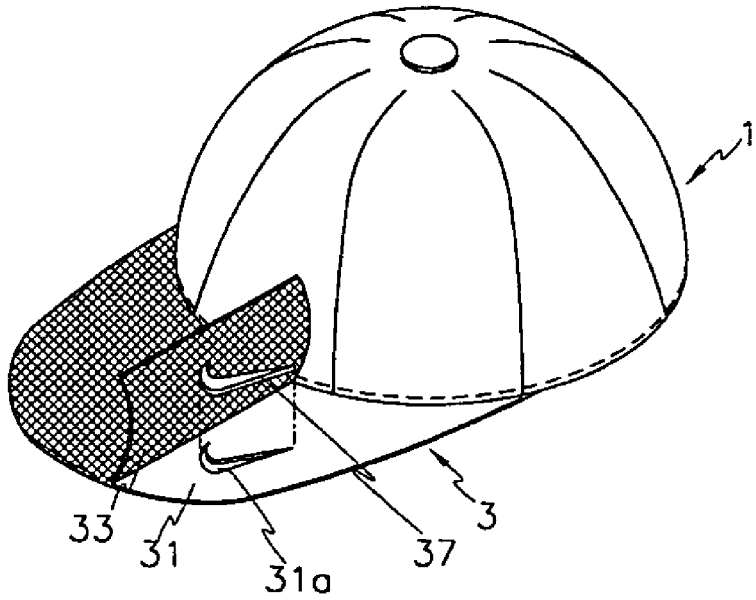
FIG. 5 is a view of a cap according to a third embodiment of the present invention.

FIG. 5 shows a cap according to a third embodiment of the present invention. In this third embodiment, a filler 37 formed of material having a different color to that of the shape-maintaining member 31 is filled in the symbol portion 31*a* and the top and bottom cloth covers the visor portion. The filler 37 may be formed by filling liquid material in the symbol portion 31*a* and hardening the same or by molding the filler 37 in an identical shape to the symbol portion 31*a* and fitting the same in the symbol portion 31*a*.

Figure 6:
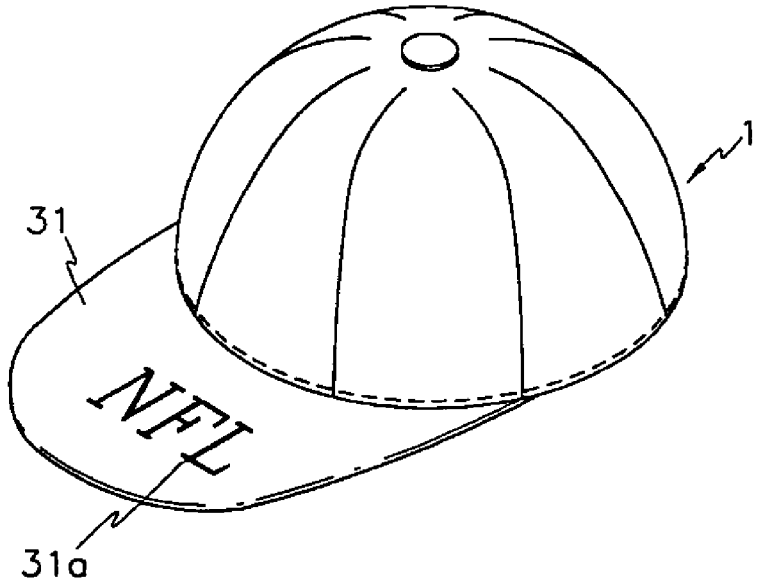
FIG. 6 is a view of a cap according to a fourth embodiment of the present invention.

FIG. 6 shows a cap according to a fourth embodiment of the present invention.

The cap of this embodiment is similar to that of the second embodiment except that a symbol portion 31*a* is not filled with the filler 37 but remains empty. In this embodiment, since the shape-maintaining member 31 is not covered with additional top and bottom cloth 33 and 35, manufacturing costs are reduced.

As described above, since a symbol portion including such things as characters and logos is provided on the shape-maintaining member constituting the visor portion, the esthetic appearance can be improved, while obtaining an advertisement effect.

In addition, when material having a different color is filled in a space defining the symbol portion, a cap having a variety of esthetic appearances can be manufactured.

Furthermore, by making the top and bottom cloth using mesh cloth, transparent or semitransparent cloth, or a cloth containing luminous material, the esthetic appearance may be further improved.

It will be apparent to those skilled in the art that various modifications and variations can be made to the cap of the present invention without departing from the scope of the invention. The present invention covers the modifications and variations of this invention provided they come within the scope of the appended claims and their equivalents.

What is claimed is:

1. A cap comprising:

a crown portion being disposed on a head; and a visor portion for shielding a face from sunlight, the visor portion being coupled to the crown portion, wherein the visor portion comprises:

a shape-maintaining member to maintain a predetermined shape of the visor portion, a symbol portion directly formed on the shape-maintaining member as an engraved groove or a hole, the symbol portion being filled with a filler whose material and color are different from those of the visor portion; and a cover to cover the shape-maintaining member and the symbol portion, the symbol portion being viewed therethrough.

2. A cap as recited in claim 1, wherein the cover is a mesh cloth.

3. A cap as recited in claim 1, wherein the cover is selected from the group consisting of a transparent cloth and a semitransparent cloth.

4. A cap as recited in claim 1, wherein the cover contains luminous material.

5. A cap comprising:

a crown portion being disposed on a head; and a visor portion for shielding a face from sunlight, the visor portion being coupled to the crown portion, wherein the visor portion comprises:

a shape-maintaining member to maintain a predetermined shape of the visor portion, and a symbol portion directly formed on the shape-maintaining member as an engraved groove or a hole which is filled with a filler, a material and a color of the filler being different from a material and a color of the shape-maintaining member.

6. A cap comprising:

a visor comprising:

a shape-maintaining member to maintain a predetermined shape of the visor; and a symbol portion directly formed on the shape-maintaining member as an engraved groove or a hole, wherein the symbol portion is filled with a filler whose material and color are different from those of the visor.

* * * * *